US006312252B1

(12) United States Patent
Klintworth

(10) Patent No.: US 6,312,252 B1
(45) Date of Patent: Nov. 6, 2001

(54) COOLER FOR COMBUSTION PRODUCTS

(75) Inventor: Klaus Klintworth, Buxtehude (DE)

(73) Assignee: BMH Claudius Peters GmbH, Buxtehude (DE)

( * ) Notice: Subject to any disclaimer, the term of this patent is extended or adjusted under 35 U.S.C. 154(b) by 0 days.

(21) Appl. No.: 09/703,555

(22) Filed: Nov. 1, 2000

(30) Foreign Application Priority Data

Nov. 3, 1999 (EP) ..... 99121757

(51) Int. Cl.[7] ..... F27D 15/02
(52) U.S. Cl. ..... 432/77; 432/79; 432/80
(58) Field of Search ..... 432/77, 78, 79, 432/80; 110/267, 270, 271, 272

(56) References Cited

U.S. PATENT DOCUMENTS

| | | | | |
|---|---|---|---|---|
| 3,089,688 | | 5/1963 | Ostberg | 263/32 |
| 4,457,081 | * | 7/1984 | von Vedel | 432/77 |
| 4,503,783 | * | 3/1985 | Musschoot | 432/77 |
| 4,732,561 | | 3/1988 | Eiring et al. | 432/78 |
| 4,762,489 | * | 8/1988 | Schmits et al. | 432/77 |
| 5,771,819 | * | 6/1998 | Saitoh | 110/267 |

FOREIGN PATENT DOCUMENTS

| | | |
|---|---|---|
| 1108606 | 6/1961 | (DE) . |
| 1953415 | 4/1971 | (DE) . |
| 0 359 108 A1 | 3/1990 | (EP) . |
| 0 718 578 A2 | 6/1996 | (EP) . |
| 0 726 440 A1 | 8/1996 | (EP) . |
| 0 676 031 B1 | 9/1996 | (EP) . |
| 926470 | 5/1963 | (GB) . |
| WO 84/01616 | 4/1984 | (WO) . |

OTHER PUBLICATIONS

European Search Report EP 99 12 1757.1 dated Feb. 18, 2000.

* cited by examiner

*Primary Examiner*—Gregory Wilson
(74) *Attorney, Agent, or Firm*—Alix, Yale & Ristas, LLP

(57) ABSTRACT

Cooler for combustion products, with a conveyor through which air flows, which cooler is formed by a stationary grate surface (7) and a conveyor (8). The conveyor contains a plurality of drivers (9) moved at a distance from one another over the grate surface. A pre-space (30) is formed at the back of the feed stream fed to the grate (7,8), which pre-space is delimited on the underside by the conveyor (7,8) and accommodates a slope of the products to be cooled. The products in the pre-space are intensively cooled and surround the drivers in a protective manner as the latter enter the hot product bed.

16 Claims, 4 Drawing Sheets

COOLER FOR COMBUSTION PRODUCTS

BACKGROUND OF THE INVENTION

It is known to cool combustion products (for example cement clinker) by a layer of the combustion products being conveyed on a grate, while cooling air is forced through the grate and the product layer. In a known type of such a cooler (EP-B-676031; EP-A-718578; WO-A-8401616), a stationary grate surface is used, over which the product bed is moved by means of a conveyor. The latter consists of a pair of endless conveyor chains which are arranged on both sides of the grate and between them carry drivers which lie transversely to the conveying direction and drive the products lying between and above them in the conveying direction, that is to say in the longitudinal direction of the cooler. The driver beams are surrounded by hot products and are therefore exposed to wear. This applies particularly to the initial region of the cooler, where the hot products to be cooled, emerging directly from the furnace, meet the drivers.

When the stream of products to be fed onto the grate meets the conveying grate and its drivers directly, high wear and high mechanical stress occur. In order to avoid this, there may be provision (EP-B-676031, EP-A-718578) for the combustion products first to fall onto a stationary surface which consists of grate plates with air throughflow and from which the products are moved, even without additional conveying means, towards the start of the conveying grate solely by virtue of an inclination of this surface. In order to ensure that the products have a dwell time sufficient for precooling, the surface is inclined only slightly and has a considerable length. This presents problems in terms of a uniform operation of the cooler, particularly in the case of difficult products which tend to cake on and cake together.

In another known cooler of the type just described (EP-A-726440) the grate and the drivers are protected in that, before the feed of the products to be cooled, a layer of already cooled products returned from the end of the grate to the start is fed. The grate and the drivers are protected, by the cool product layer enveloping them, from the hot product layer located above it. The outlay for returning the cooled products and for conveying double the quantity of products on the grate is high.

SUMMARY OF THE INVENTION

The object of which the invention is based is to reduce the thermal stress and the wear of the conveying grate in the initial region, in particularly at the drivers.

The solution according to the invention lies in the features of claim 1 and preferably in those of the subclaims.

According, there is provision for the drivers to run through a pre-space which is protected against the direct inflow of products and contains an intensively cooled slope of the product bed, before said drivers enter the feed region. As soon as a driver has entered this pre-space, it pushes forwards in the conveying direction part of the material which has accumulated in said pre-space. Other parts of the displaced products pour over it opposite to the conveying direction and settle behind it, together with products newly introduced to the slope, on the stationary grate surface, where, at a standstill, they are exposed to the influence of the cooling air until the next driver appears in order to drive them along. They have then already assumed a lower temperature, so that the driver comes into contact only with precooled products. This shields it on all sides against the fresh uncooled products. This applies not only as long as it is located in the pre-space upstream of the discharge limit of the products, but also downstream thereof, because it is located in the lower to medium height range of the product layer, this range being formed mainly by precooled products, while the newly arriving uncooled products come to rest on the top side of the layer. This sample measure affords effective protection of the drivers against thermal stress caused by uncooled products and against these products impinging directly on them. This also applies to the stationary grate surface.

In an apparatus for feeding bulk products onto the conveyor belt of a sintering plant (EP-A-359108), it is known for the product bed to be drawn off from a pile which is delimited, on the side opposite to the conveying direction, by a wall located at a distance from the conveyor belt. A slope is formed, opposite to the conveying direction, in the region of the orifice formed between the conveyor belt and the lower edge of this wall, the result of this being intended, in a way which is not easy to understand, to prevent the segregation of the material to be sintered. This has nothing to do with the present invention.

As regards travelling grates, it is known (U.S. Pat. No. 4,732,561, DE-A-1953415, DE-B-1108606) to delimit the feed region above the grate by means of a cooled oblique surface which terminates at a distance above the grate. No reference to the idea of the present invention is found on it.

The shape of the pre-space is not critical, insofar as it is covered on the top side in such a way that the conveying grate is not struck directly by the feed stream in the region of the pre-space. It may be expedient, however, to limit the height of the slope, in that the devices delimiting the feed stream on its side facing opposite to the conveying direction form an edge, from which the pre-space opens and from which the surface of the slope falls, opposite to the conveying direction, towards the conveying grate. In this case, it is advantageous, in general terms, if the height of the pre-space is dimensioned so as to be essentially sufficient for receiving the slope. In other words, its height is everywhere approximately at least the same as corresponds to the slope angle emanating from said edge. For example, the upper delimitation of the pre-space may be formed by an oblique surface descending opposite to the conveying direction. In some cases, it is expedient to make the height of the pre-space a little lower than corresponds to the height of the slope, so that no interspace, through which cooling air can escape, remains between the surface of the slope and the upper delimitation of the pre-space. The cooling air is thereby prevented from escaping through the regions of least height of the slope. It may be expedient, furthermore, if the length of the pre-space, as measured in the conveying direction of the grate, is a little shorter than the slope length, so that a region which is free of bulk products and through which air can escape, without combustion products being cooled, is not formed between the running-out end of the slope and the delimitation of the pre-space. However, this possibility may also be prevented by the air permeability of the grate surface being reduced or blocked on the far side of the region which is occupied in any event by the slope.

So that the length of the pre-space suffices for the products to have a dwell time sufficient for pre-cooling, said length is expediently equal to the speed of advance of the drivers, multiplied by the desired dwell time, and at the same time the latter should be at least of the order of magnitude of 0.5 to 3 min. In the case of a speed of advance of the drivers of 0.5 m/min, a length of the pre-space of 0.5 to 1 m has proved advisable. The longitudinal distance between the drivers is expediently of the same order of magnitude. It should be greater than 0.8 times the length of the pre-space.

In order to seal off the cooler space and, in particular, the pre-space sufficiently in relation to the surrounding atmosphere, it is expedient if, upstream of the pre-space, the drivers run through a closed-off duct, the length of which is at least equal to the distance between them. The delimitation of the conveying stream is expediently formed by an oblique surface descending in the conveying direction and terminates at said edge from which the pre-space and the slope emanate.

The descending oblique surface is expediently equipped with ventilated grate plates. In contrast to the prior art mentioned in the introduction, it does not need to be so long that the conveying grate is entirely removed from the product feed region. Said oblique surface may therefore be designed to be short and correspondingly steep in the conveying direction, so that the behaviour of the products meeting the oblique surface does not essentially present any problems. Moreover, the oblique surface may be movable, so that, for example, building-up caked-on and caked-together products (so-called snowmen) can easily be detached. An intermittent movement is, as a rule, sufficient for this purpose. In particular, the oblique surface may be pivotable about an axis near said edges. The margin which delimits the oblique surface at the end of the latter remote from the pivot axis should be as closely as possible adjacent to the neighbouring wall. This wall is therefore expediently curved in the form of an arc of a circle, the centre of curvature coinciding with the pivot axis of the oblique surface. The wall curved in the form of an arc of a circle is expediently formed by ventilated grate plates which are laid polygonally in an approximation to an arc of a circle.

In the case of a cooling grate which is formed by a stationary grate surface and a conveyor chain arranged above it, it may be that small product particles fall through the orifices or gaps in the grate. These so-called grate screenings have to be removed from the space below the grate. The prior art makes use, for example, of separate dragchain conveyors for this purpose. According to the invention, the arrangement may be simplified in that the lower strand of the grate conveyor led in a closed loop is used as a dragchain conveyor. For this purpose, said lower strand lies directly or with some clearance on a stationary conveying surface, onto which the grate screening passes and from which the latter is discharged by the grate conveyor drivers resting on it.

In a development of this idea of the invention, the dragchain conveyor may be continued as far as the start of the conveying grate, in that the wall forming the stationary conveying surface of the dragchain conveyor is led upwards, in contact with the conveyor, in the region of the deflection provided at the start of the conveyor, until the material carried along by said conveyor can be taken over by the stationary grate surface or by an inner wall which is located in the deflection region and which is continued by the stationary grate surface. The inner and outer walls, which enclose the conveyor at least over a length corresponding to the distance between the conveying beams, seal off the space below the grate in relation to the conveyor. Corresponding sealing-off may also be provided in the region of the other deflection of the conveyor. After leaving the grate surface, the conveyor runs, in the region of its deflection, through a sealing duct between a wall adjoining the grate surface on the inside and an outer wall which, further along, forms with the lower strand of the conveyor the dragchain conveyor. The features (corresponding to claims 14 to 16) which are specified in this paragraph merit protection, where appropriate, independently of the other features of the invention.

BRIEF DESCRIPTION OF THE DRAWINGS

The invention is explained in more detail below with reference to the drawing, which illustrates an advantageous exemplary embodiment and in which.

DETAILED DESCRIPTION OF THE PREFERRED EMBODIMENT

Figure 1:
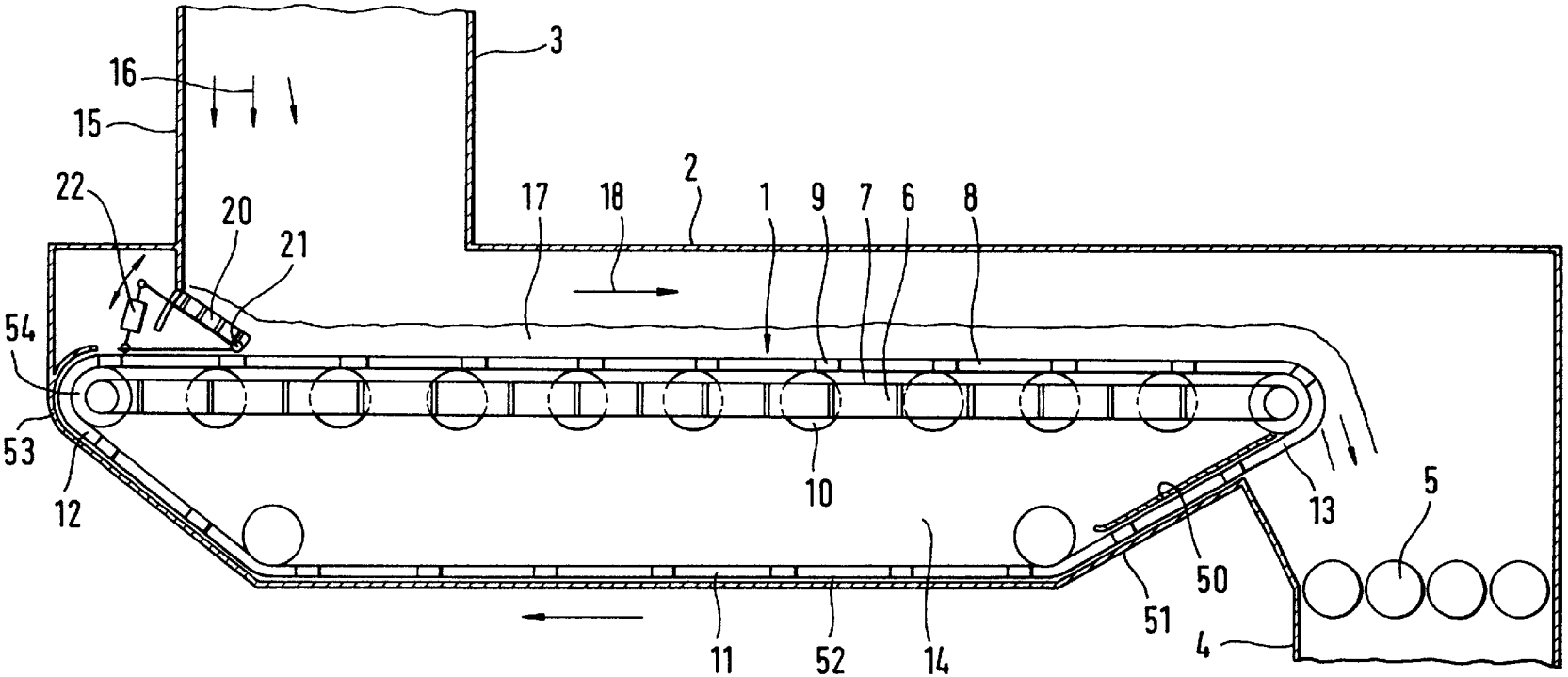
FIG. 1 is a schematic, longitudinal, cross-section view of a first embodiment of a cooler in accordance with the invention.

The conveying grate 1 is contained in a housing 2 having a feed shaft 3, in which, for example, the discharge end of a rotating tubular kiln terminates. Said housing forms, furthermore, an outlet shaft 4 which may contain a breaker 5. Details of the housing design and of the supply and discharge of cooling air do not need any explanation, since they are known.

The conveying grate consists of a stationary grate part 6, the top side of which forms a stationary grate surface 7, and of a conveyor 8, which, on both sides of the stationary grate part 6, has a pair of pullchains guiding between them drivers which, in the example illustrated, are designed as so-called conveying beams 9. The chains may be supported and guided by wheels 10. The conveyor may also be designed differently, for example in the form of one or more conveyor worms. It is critical that, in each case, there be a plurality of drivers which are at a distance from one another in the conveying direction.

The stationary grate part 6 contains cooling-air passage orifices for cooling air supplied via the pressurized space 14 below the grate. As is known, the space below the grate may be subdivided in to a plurality of chambers which make it possible for different sections of the cooler to be subjected to different cooling-air pressure. The result is a possibility of supplying the cooling air directly to the elements forming the stationary grate part 6 by means of a hose connection or pipe connection. Details do not need any explanation since they are known.

In the example illustrated, the conveyor is led in a closed loop, its upper strand running over the stationary grate surface 7 and its lower strand 11 being returned in a space below the grate. Located between them are a feed-side reflection 12 and an outlet-side deflection 13. Details of these are dealt with further below.

The hot combustion products are discharged from the kiln outflow in the feed shaft 3 and form as a whole the feed stream indicated by arrows 16, though the term "feed stream" is not intended to refer in any way to the density of this stream.

On the conveying grate, a product bed 17 forms which rests on the stationary grate surface 7 and is driven in the conveying direction 18 by the movement of the conveying beams 9. The conveying beams 9 expediently have a height clearance relative to the stationary grate surface 7 such that a stationary or slightly moved relatively cool product layer forms between them, with result that the wear on the stationary grate surface is reduced. The latter may be provided, moreover, with devices which promote the formation of such a stationary product layer by generating a sliding resistance. For example, depressions, pockets, transverse ribs etc., may be provided in the grate surface, which retain or brake the products interacting directly with them. The clearance between the drivers 9 and the grate surface 7 is expediently between 50 and 200 mm. The bed height is, in particular, 400 to 1000 mm and the height of the conveying beams 100 to 250 mm.

In that region of the feed shaft 3 which is at the rear (in the conveying direction) and where the impingement of heavy lumps must be expected, an oblique surface 20 descending in the conveying direction is provided above the conveying grate. Said oblique surface is formed by grate plates which are provided with a cooling-air connection for the purpose of their own cooling and for cooling the products located on them. The oblique surface 20 is pivotable about the axis 21 by means of a suitable drive which is indicated at 22 as a hydraulic cylinder. During operation, the oblique surface 20 is normally stationary in a specific inclined position. The drive 22 may serve for setting different angles of inclination. It is provided, above all, for pivoting the oblique surface 20 back and forth, in order to induce or facilitate the discharge of material which is caking together. For example, it can be set in pivoting motion intermittently at regular time intervals in order to prevent the build-up of so-called snowmen.

Figure 2:
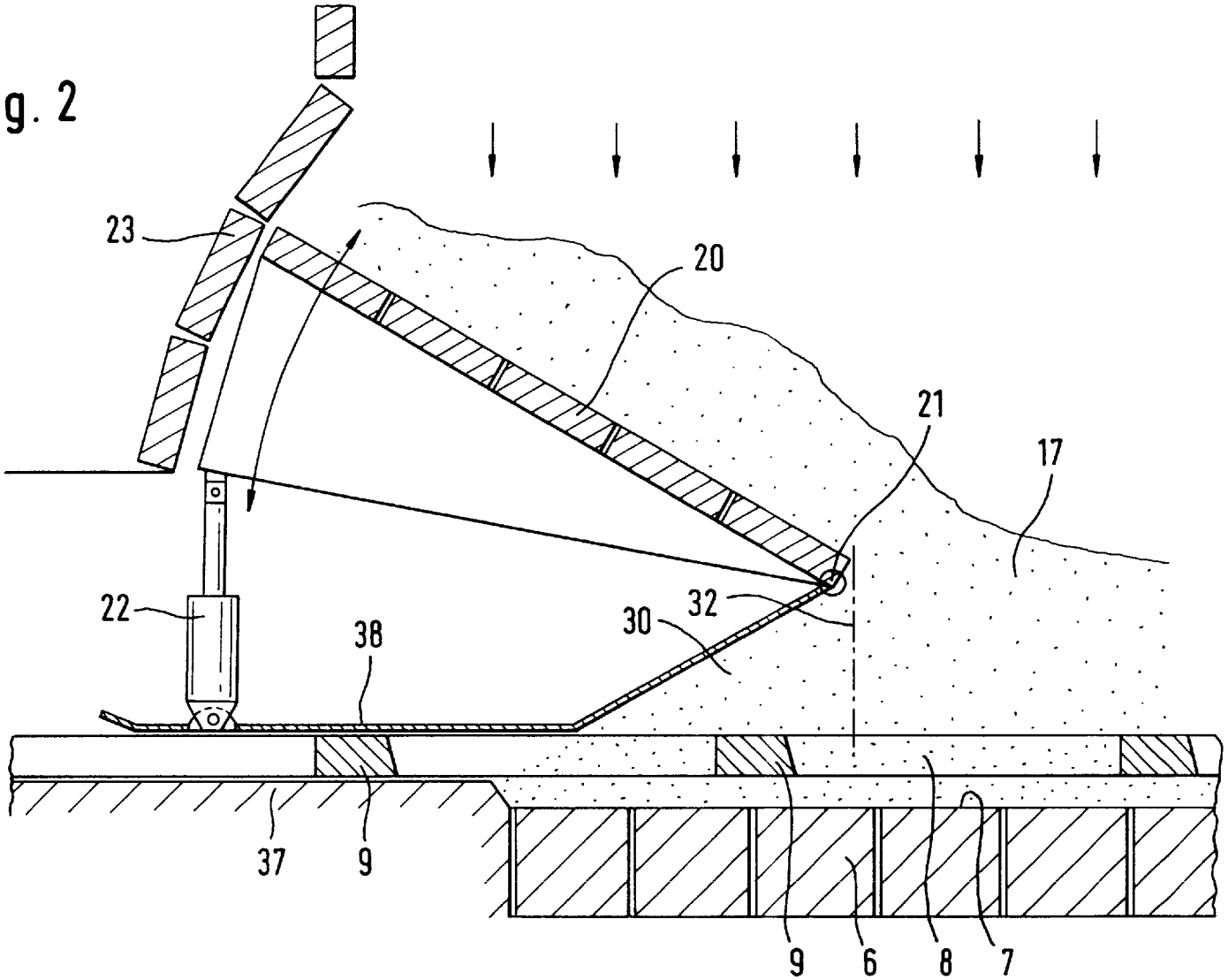
FIG. 2 is an enlarged schematic, cross-section view of the feed region of FIG. 1.

The wall part 23 (see FIG. 2) located behind the oblique surface 20 is matched in the form of an arc of a circle to the arc movement of the rear edge of the oblique surface 20 and likewise consists of ventilated grate plates.

The products falling onto the oblique surface 20 gradually slip down from this due to the inclination, at the same time experiencing intensive cooling as a result of being subjected to cooling air. They subsequently fall onto the conveying grate 1 so as to form the bed 17 on the latter. Part of the feed stream may also fall directly onto the conveying grate 1 or onto the bed 17 located there. However, this part consists of relatively small fragments which do not greatly load the conveying beams 9 when they impinge on them, especially since these are largely protected by the product bed 17. Nor is the heat load emanating from the smaller particles so high, because they cool more quickly than the coarse fragments. These, however, pass onto the conveying grate only when they have already been pre-cooled on the oblique surface 20.

Below the front lower end of the oblique surface 20 is located the pre-space 30 already mentioned, which is delimited on the underside by the conveying grate and is open towards the product bed 17. The orifice of said pre-space is delimited by the front edge 31 of the oblique surface 20 which, by the vertical line 32 indicated by dashes and dots, also defines the limit up to which the feed stream can meet the conveying grate directly, said feed stream being composed of the products falling down from the kiln and flowing down from the oblique surface 20.

Figure 3:
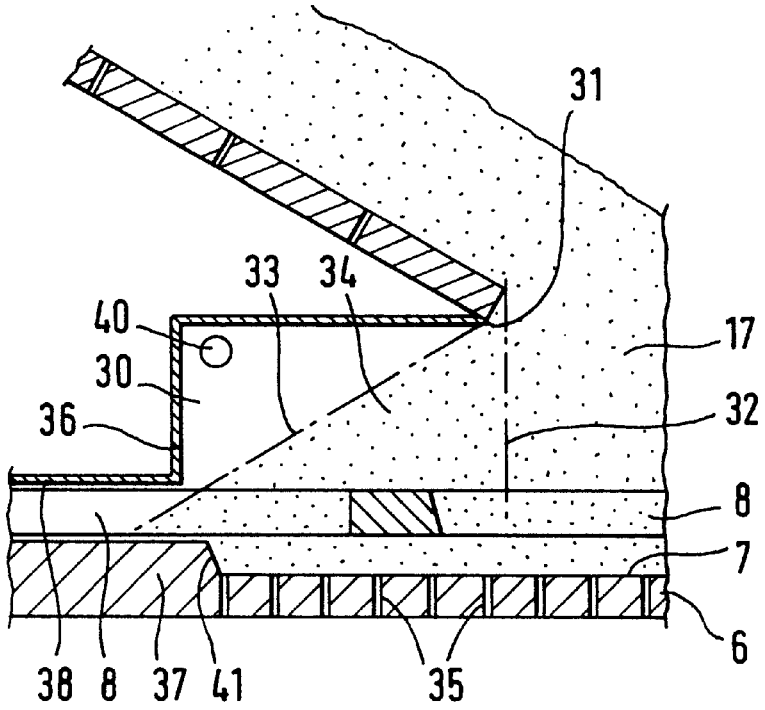
FIG. 3 is a schematic, cross-section view of a second embodiment of the feed region of FIG. 2.
Figure 4:
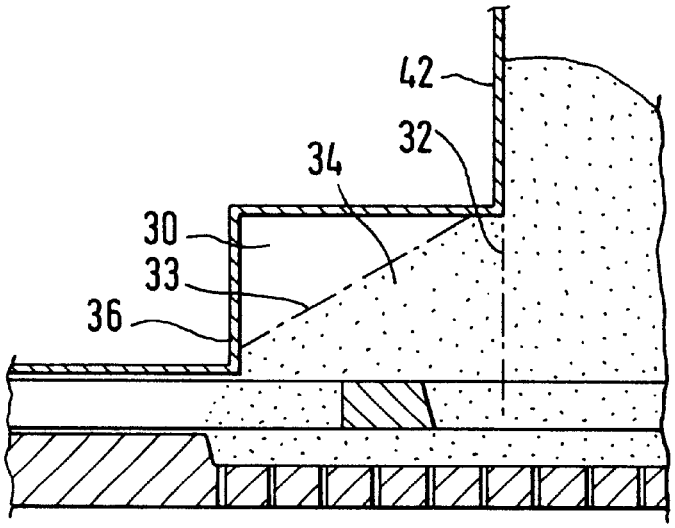
FIG. 4 is a schematic, cross-section view of a third embodiment of the feed region of FIG. 2.

Since the pre-space 20 is open towards the product bed 17, the products are piled into it, specifically at the slope angle which is indicated at 33 by dashes and dots in FIGS. 3 and 4. The height of the edge 31 therefore determines the size of the slope 33. The edge 31 should, in general, have a lower height than the adjacent product bed 17. There may be instances, however, in which this is not necessary, so that the surface 33 of the slope 34 does not emanate from the edge 31, but is lower. It goes without saying that the so-called edge 31 does not need to be made sharp-edged.

The stationary grate part 6 is also located below the pre-space 30. It is also ventilated in the region of the pre-space 30, as indicated diagrammatically in FIGS. 3 to 6 by ducts 35 in the grate part 6. The ventilated portion of the stationary grate part 6 terminates near that delimitation 36 of the pre-space 30 which is at the rear (in the conveying direction). Behind said pre-space, the stationary grate part 6 is continued by an unventilated portion 37 which is expediently adjacent to the conveyor 8 without any appreciable clearance. Also located in this region, above the conveyor 8, is a wall 38 closely adjacent to the latter. The duct enclosing the conveyor 8 and formed by the walls 37, 38 located opposite one another has a length which corresponds at least to the distance between the conveying beams 9 in the conveying direction, so that in said duct there is constantly at least one beam 9 which largely blocks the outflow of air between the walls 37, 38. The mutually confronting surfaces of the walls 37, 38 therefore form, together with the beam 9 located in them, a barrier against the outflow or inflow of air.

The pile 34 contained in the pre-space 30 is exposed to intensive cooling. This cooling is more intensive than would be the case outside the limit 32 in the region of the product bed 17, because the product quantity exposed to the cooling-air stream is smaller. Care may also be taken to ensure that said stream flows through it particularly intensively, for example by an increase in the pressure difference giving rise to the cooling-air stream. For this purpose, the pre-space 30 may be provided above the slope 34 with a special air offtake 40. Cooling is also particularly effective in the region of the slope because the latter is formed mainly by smaller particles.

The sloping material 34 contained in the pre-space 30 is, it is true, driven intermittently by the conveying beams 9 passing through. However, while these are moving through the pre-space, the material located in front of and above them pours into the space freed behind them and settles there on the stationary grate surface 7. Said material has cooled to a great extent by the time the next conveying beam appears. Since the latter, when it enters the free product bed 17, is largely driving this material and is enveloped by it, said conveying beam, even there, for the time being remains largely protected from the direct influence of the hotter products.

The pre-space is to be sufficiently long in the conveying direction to allow the products located in it a dwell time sufficient for precooling. This is, as a rule, a few minutes. The rule that the length of the pre-space corresponds approximately to half to double the distance between the conveying beams has proved appropriate. The height of the edge 31 is expediently selected such that the entire length of the pre-space 30 is occupied by the slope 34. This is expedient alone with regard to economical utilization of space. The situation where cooling air escapes through a free gap between the slope and the rear edge 36 of the pre-space can also be avoided in this way. FIG. 4 shows such an arrangement, in which the length of the pre-space 30 is a little shorter than that of the slope 34, so that the rear wall 36 of the pre-space 30 cuts off the slope and thereby causes air to be closed off. However, a flow around the slope may also be avoided by the transition 41 from the ventilated part of the grate 6 to the unventilated part 37 being arranged such that it is in any event located within the length of the slope 34, as shown in FIG. 3.

It may be gathered from FIG. 4 that the pre-space does not necessarily have to be formed below an oblique surface 20, but may also be formed, for example, in a vertical wall 42. In this case, too, it is located behind the limit 32 of the direct feed stream.

Figure 5:
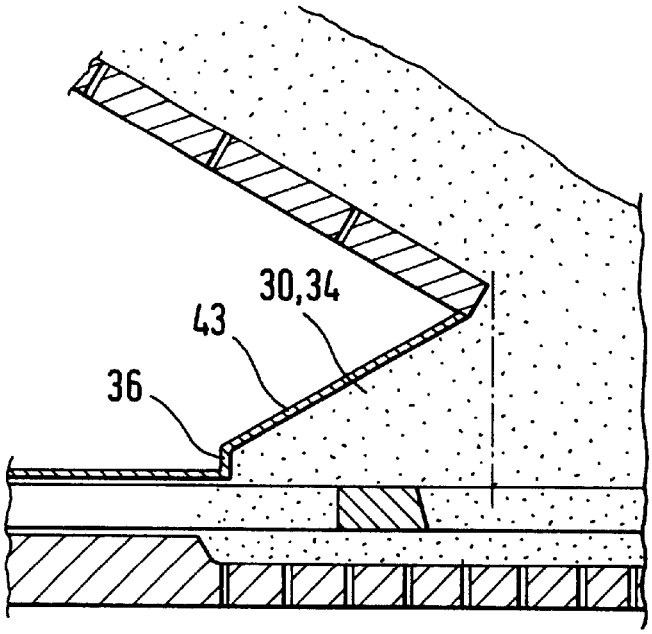
FIG. 5 is a schematic, cross-section view of a fourth embodiment of the feed region of FIG. 2.
Figure 6:
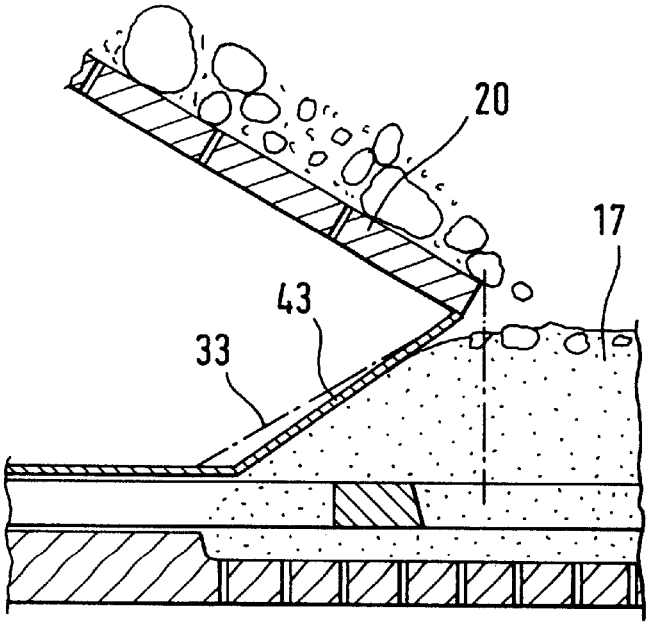
FIG. 6 is a schematic, cross-section view of a fifth embodiment of the feed region of FIG. 2.

In the exemplary embodiment according to FIG. 5, the upper wall 43 of the pre-space 30 is arranged to follow the slope angle 33 (FIG. 3), so that the pre-space is filled essentially completely by the slope. By contrast, in the exemplary embodiment according to FIG. 6, the angle of the upper wall 43 is arranged so as to be a little steeper than the slope angle 33 indicated by dashes and dots, so as to ensure that the pile is contiguous to the wall 43 without any interspace. What is brought about thereby is that the cooling air entering the pre-space from below has to pass through the entire slope, so that cooling air flows reliably through even the thicker part of the slope. FIG. 6 also shows that the height of the product bed 17 does not in all instances need to attain the height of the edge 31 delimiting the pre-space 30.

In the deflection region 13, the stationary grate part 6 is followed by a wall 50 resting against the conveyor 8 on the inside. On a portion corresponding at least to the distance between two conveying beams 9, said wall forms, with a wall 51 correspondingly resting against the conveyor on the outside, a sealing duct. The wall 51 is also continued in the region 52 of the lower strand of the conveyor, the conveying beams resting on the surface formed by the wall 52 or having a slight clearance relative to said surface. What is brought about thereby is that the conveyor forms, with the wall 52, a dragchain conveyor, by means of which any grate screenings are transported away.

So that the grate screenings are supplied again to the product bed located on the top side, the wall 52 is continued, in the region of the deflection 12, as a wall 53. As soon as the inclination of the conveyor 8 beings to draw nearer to the vertical direction at this deflection 12, care is taken to ensure that, on the inside of the conveyor too, there is a delimitation which, in the case illustrated, is formed by a deflecting roller 54, but also may be formed by a wall which corresponds to the wall 50 at the deflection 13. The grate screenings carried along by the conveyor are thus led onto the top side of the stationary grate part 6 and pass back into the product stream in the simplest possible way.

What is claimed is:

1. Cooler for combustion products, with a conveying grate for conveying a product bed through which cooling air flows, said cooler having a feed region, a stationary grate surface, a conveyor, and a device for limiting the product feed stream, the conveyor moving in a conveying direction and having a plurality of drivers moved at a distance from one another over the grate surface in the conveying direction, the device for limiting the product feed stream having first and second sides, the first side facing in the conveying direction and the second side facing opposite to the conveying direction, the device forming on the second side a pre-space which is protected against the direct inflow of products and through which the drivers run before they enter the feed region, said pre-space being delimited to the underside by the grate, said pre-space also being open towards the product bed to such an extent that a slope of the products is formed in the pre-space, the cooler also having apparatus for the intensive cooling of the slope of products.

2. Cooler according to claim 1, wherein the device for limiting the feed stream forms an edge, defining the upper delimitation of the pre-space.

3. Cooler according to claim 2, wherein the edge is formed by an oblique surface descending in the conveying direction.

4. Cooler according to claim 3, wherein the oblique surface is formed by ventilated grate plates.

5. Cooler according to claim 3, wherein the oblique surface is intermittently movable.

6. Cooler according to claim 5, wherein the oblique surface is pivotable about a pivot axis disposed near the edge.

7. Cooler according to claim 6, further having a wall which is curved in the form of an arc of a circle having an axis of curvature which is closely adjacent to the pivot axis of the oblique surface.

8. Cooler according to claim 7, wherein the wall is formed by ventilated grate plates which are laid polygonally in an approximation to an arc of a circle.

9. Cooler according to claim 1, wherein the pre-space has a height dimensioned so as to be substantially sufficient for receiving the slope of products.

10. Cooler according to claim 1, wherein the pre-space has a length and the slope of products has a slope length, the length of the pre-space being shorter than the slope length.

11. Cooler according to claim 1, wherein the conveyor has a speed of advance and the pre-space has a length, the length of the pre-space being substantially equal to a distance equal to the speed of advance of the conveyor, multiplied by 0.5 to 3 minutes.

12. Cooler according to claim 1, wherein the pre-space has a length and the distance between the drivers is greater than 0.8 times the length of the pre-space.

13. Cooler according to claim 1, wherein upstream of the pre-space, the drivers run through a sealing duct, the length of which is at least equal to the distance between the drivers.

14. Cooler according to claim 1, wherein the conveyor has a lower strand forming a dragchain conveyor.

15. Cooler according to claim 14, wherein the dragchain conveyor is continued as far as the start of the conveying grate.

16. Cooler according to claim 14, wherein the conveyor has a deflection region downstream of the grate surface and the cooler further has a sealing duct disposed within the deflection region, the sealing duct comprising an inner wall adjoining the grate surface on the inside and an outer wall adjoining the grate surface on the outside, a portion of the outer wall and the lower strand defining the dragchain conveyor.

* * * * *

UNITED STATES PATENT AND TRADEMARK OFFICE

CERTIFICATE OF CORRECTION

PATENT NO. : 6,312,252 B1
DATED : November 6, 2001
INVENTOR(S) : Klintworth

It is certified that error appears in the above-identified patent and that said Letters Patent is hereby corrected as shown below:

Column 8,
Line 1, after “delimited” delete “to” and insert -- on --.

Signed and Sealed this

Twenty-sixth Day of November, 2002

*Attest:*

*Attesting Officer*

JAMES E. ROGAN
*Director of the United States Patent and Trademark Office*